United States Patent [19]

Aurness et al.

[11] Patent Number: 4,995,661

[45] Date of Patent: Feb. 26, 1991

[54] ANIMAL FECES RETRIEVER

[76] Inventors: Harold O. Aurness, 5808 Knox Ave. N., Brooklyn Center, Minn. 55430; Thomas G. Mahler, 3841 Unity Ave. N., Robbinsdale, Minn. 55422

[21] Appl. No.: 419,506

[22] Filed: Oct. 10, 1989

[51] Int. Cl.[5] ..... A01K 29/00

[52] U.S. Cl. ..... 294/1.4; 294/100

[58] Field of Search ..... 294/1.4, 1.3, 19.1, 294/100, 115; 81/53.11, 53.12

[56] References Cited

U.S. PATENT DOCUMENTS

| | | | |
|---|---|---|---|
| 4,078,838 | 3/1978 | Nadratowski | 294/1.4 |
| 4,225,169 | 9/1980 | DeToma | 294/1.4 |
| 4,477,111 | 10/1984 | Crooks | 294/1.4 |

FOREIGN PATENT DOCUMENTS

| | | | |
|---|---|---|---|
| 1183742 | 3/1985 | Canada | 294/1.4 |

*Primary Examiner*—Margaret A. Focarino

*Assistant Examiner*—Dean J. Kramer

[57] ABSTRACT

A feces retriever is shown as including a set of several flexible stays arranged in a cone-shaped manner to trap a feces within a plastic bag held within the stays when pulled together by a ribbon connecting the stays at the bottom. The stays extend down from a collar slideably attached on a hollow shaft which is pulled up from a retracted position within the stays by pulling a handle on a second hollow shaft within the first shaft. The first shaft becomes locked in extended position by a holding mechanism on the top of the stay collar. The second shaft pulls the ribbon strands, which run up the inside of the shaft from a gathering ring attached to a spring lock at the bottom of the shaft, to a crossbar in the shaft and back down to fasten to the outside of the stay collar. The spring lock holds the second shaft in extended position above the first shaft which holds the bottom of the stays by means of the ribbon in a tight, closed position while the bag is tied before removal.

8 Claims, 1 Drawing Sheet

ANIMAL FECES RETRIEVER

SUMMARY

Figure 4:
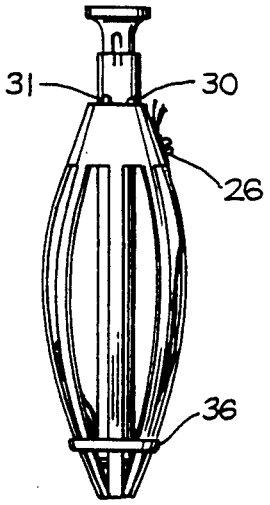

This invention relates to means for picking up small animal feces in a sanitary manner where the hands do not touch the feces. The waste is trapped within a plastic bag slung from a hook at the bag's closed end among several flexible stays extending downward in a cone shape with the open end of the bag folded up over the outside of the stays. A ribbon connecting the bottom of the stays converges at a gathering ring above the hook and travels in two strands up the interior of a tube slideably placed within a housing tube to a crossbar and back down the tube to exit at the bottom where it is fastened to the outside of a collar holding the stays surrounding the bottom of the housing tube. The housing tube is extendable up through the stay collar where it locks in position and, combined with the sliding tube guided by a groove within the housing tube, enables the unit to be compressed for storage or to be locked in an extended position with the stay bottoms pulled together by the ribbon when a spring part of the gathering ring, attached to the bottom of the sliding tube locks into an opening in the housing tube when pulled up. The plastic bag may then be tied closed and detached from the hook after the sliding tube is retracted letting the stays spread.

BACKGROUND OF THE INVENTION

In the modern world where most people live in urban areas and many have pets, it is desirable to be able to retrieve the waste of their pets for sanitary and cleanliness reasons. Many cities have laws mandating that pet owners pick up the feces of their animals as they walk them.

The prior art in this field pretty well meets the problem described. However, improvement in the present invention helps advance the progress in the areas of compactness of size and function.

Although several devices in the field have telescoping parts to make them compact, they don't seem designed to reduce in length as much as the present invention which can be made short enough to fit in a pocket or purse. Several devices are intended to double as canes which dictates a longer length even if telescoped.

Other devices have pull strings outside the unit for drawing the parts together to enclose or release the waste in a bag. The present invention combines two functions in a telescoping handle which draws the stays together enclosing the feces in a bag and automatically holds the stays closed while the bag is tied by hand before removing.

DESCRIPTION OF THE PRIOR ART

In ragard to the prior art in this field, although several devices use the same general principles as the present invention, they vary in detail and function.

In Kubin there are three telescoping tubes compared to two for the present invention. A third telescoping part of the present invention is not a tube but a collar holding the stays together. In the present invention the tubes telescope into the stays rather than the reverse. Also, the means to draw the stays together in trapping the feces is one function incorporated in the handle tube.

In DeToma there are also two telescoping tubes as in the present invention but they do not telescope into the stays. Also, the stays are described as "wire shaped fingers" which indicates a cylindrical cross section whereas the stays of the present invention have a rectangular or flatish shape as indicated by the term "narrow width" claim 2.

In Crooks there is a drawing together action which has no similarity with the present invention but does use a limited telescoping action. The bag has an attaching piece on it and other special features not deemed necessary in the present invention.

In Nadratowski there are three telescoping parts combining to create a suction. It also describes a special bag with an attaching means built in it. The device doesn't look workable.

LIST OF ILLUSTRATIONS

Figure 1:
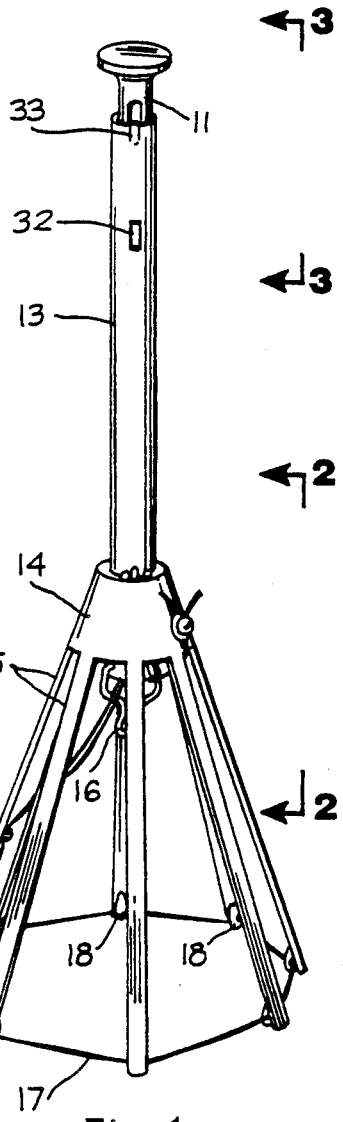

FIG. 1: A perspective view of the complete unit in receiving position.

Figure 2:
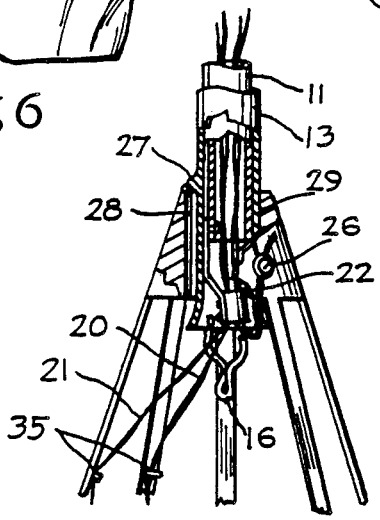

FIG. 2: A partial cut away and cross-sectional view according to section line 2—2.

Figure 3:
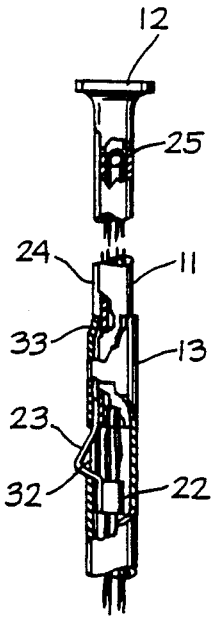

FIG. 3: A partial cut away and cross-sectional view of the unit according to section line 3—3.

FIG. 4: A view of the unit in storage position.

Figure 5:
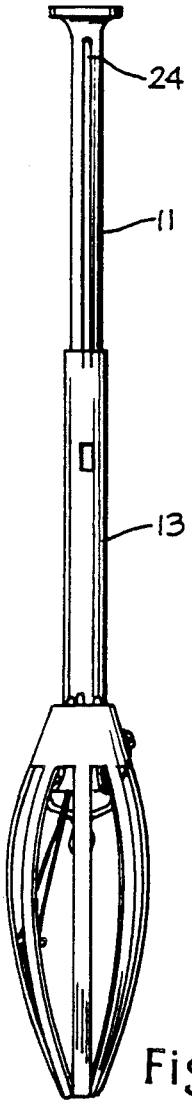

FIG. 5: A view of the unit in closed position.

Figure 6:
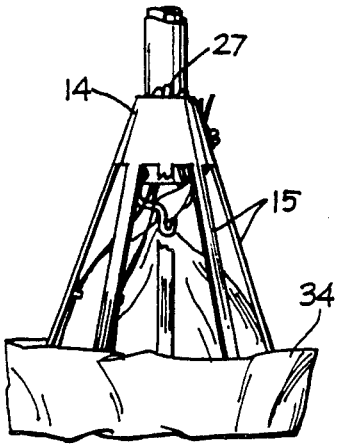

FIG. 6: A partial and cut away view of the unit with bag attached in receiving position.

DESCRIPTION

A feces retriever unit according to the teachings of the present invention is generally shown in the drawing and generally designated 10. Unit 10 generally includes a sliding tube 11, with a handle 12 at its top end, slideably placed within an exterior housing tube 13 with a cone-shaped flange 14 with its smaller end at the top slideably mounted at the bottom of the housing tube 13 with a number of spring stays 15 of a common lenght extending downward and outward from bottom of said flange in a receiving position (FIG. 1). Tube 13 has a hook 16 for attaching a plastic bag 34 by its closed end moveably mounted at its lower end. The open end of bag 34 turns up over the ends of stays 15. A pull ribbon 17 of special material connects the bottom of all the spring stays 15 circumferentially through stay eyes 18 on the inside of the spring stays and overlaps horizontally at a point 19 between two neighboring spring stays and proceeds in two separate courses, 20 and 21, in a converging manner up the two neighboring spring stays through eyelets 35 to a movable gathering ring 22 within the bottom part of the exterior housing tube 13 which said ring is connected to sliding tube 11 by a bar spring 23 attached to the lower end of a shallow groove 24 in tube 11 which said groove runs to near the top of sliding tube 11 terminating at the handle 12. The pull ribbon strand 17 extends in dual parallel course upward from the ribbon gathering ring 22 into tube 11 and to a cross pin 25 near the top of the tube where it passes around the cross pin and returns back down through sliding tube 11 to and through the ribbon gathering ring 22 and is fastened by means 26 to the outside of the cone-shaped flange 14.

When exterior housing tube 13 is pulled upward while unit 10 is in storage position (FIG. 4) after holding band 36 is removed, a knob 27 on the side of housing tube 13 near the bottom must be guided through a vertical knob groove 28 on the internal circumference of the vertical opening 29 in the cone-shaped flange 14 to exit at the top of the flange where it is held horizontally to limited lateral movement by stopper guides 30–31 on the top lip of the flange 14 and also held vertically by a horizontal twisting action which misaligns the knob 27 with the knob groove 28.

When handle 12 is pulled upward through the housing tube 13 while unit 10 is in receiving position (FIG. 1) to closed position (FIG. 5) it extends part of the pull ribbon 17 which closes the circumference at the bottom of the unit formed by the pull ribbon 17 and the spring stays 15 which encloses whatever extraneous material is within the circumference described. Housing tube 13 is widened at its lower end to prevent being pulled beyond the bottom of flange 14. Stay eyes 18 are shaped to protrude inwardly to make a tighter closing around the bag 34.

Simultaneously, unit 10 is locked in this position by the bar spring 23 when it is pulled upward by the handle 12 to release through a rectangular opening 32 near the top of the housing tube 13. Groove 24 in sliding tube 11 keeps bar spring 23 in alignment with rectangular opening 32 by a guide part 33 of the housing tube 13 riding in said groove at the top of the housing tube. At this point the collar of the plastic bag may be turned down and tied closed after which handle 12 is released for retraction by pushing bar spring 23 back into rectangular opening 32. Then the handle 12 can be retracted which opens stays 15 releasing the tied bag 34 for removal.

Further compaction of the unit 10 is achieved by twisting handle 12 to realign knob 27 in the housing tube 13 with knob groove 28 on the inside of flange 14 allowing retraction of the unit into the space circumscribed by the opened spring stays 15.

The bottom ends of spring stays 15 are rounded to prevent snagging on rough surfaces and are held in closed position for storage by holding band 36.

We claim;

1. A device for retrieving, or picking up, animal waste having a set of flexible spring stays extending down and outward in a circular cone shape from a sliding collar mounted on a housing tube, which tube is pulled up through the collar from within the cone of the spring stays, with cooperatinal means between the housing tube and collar to hold the housing tube in an extended, but retractable position and kept from further extension by a flanged end of the housing tube; a sliding tube within the housing tube having a handle at the top with a guide groove on the outside extending from below the handle to the bottom keeping the tube in alignement by a depression at the top of the housing tube riding in the groove when extending or retracting, to guide the sliding tube to holding means; a pull ribbon of a length determined for efficiency slideably connecting through eyelets at the bottom of all the spring stays with both ends extending up through a gathering ring at the bottom of the sliding tube within the housing tube and up to and over a cross member inside the sliding tube and back down through the gathering ring to be anchored to the outside of the sliding collar; spring means on the gathering ring cooperating with means in the housing tube to hold the sliding tube in an extended position which holds the bottoms of the spring stays together and which action encloses the faces within a bag removeably attached by means to the bottom of the housing tube with the open end folded up over the spring stay ends; means for holding the bottoms of the spring stays together for storage.

2. The device of claim 1 wherein a means of enclosing the animal waste comprises, in combination, a sliding collar mounted on a housing tube, several flexible spring stays of narrow with extending down and outward from the sliding collar to form a cone shape; a narrow ribbon connecting the bottoms of all the stays, which erasses between neighboring stays and runs through eyelets part way up the neighbording stays to a gathering ring attached to a sliding tube within the housing tube and proceeds up the inside of the sliding tube to a cross member and back down through the gathering ring to be fastened to the outside of the collar; wherein the faces is enclosed within a plastic bag held within the area formed by the spring stays when the sliding tube is pulled up through the housing tube by a handle on the sliding tube which draws the bottoms of the spring stays together.

3. The device of claim 1 wherein a means to hold the housing tube in an extended position comprises, in combination, a guide knob on the outside of the housing tube part way up from the bottom; a vertical groove on the inside of the collar, and stopper guides on the top edge of the collar; wherein the guide knob rides up the groove to be misaligned from the groove by twisting to rest on the top edge of the collar and ketp to limited lateral movement by the stopper guides.

4. The device of claim 1 wherein the pull ribbon is the length needed to exactly close the spring stays at the bottom.

5. The device of claim 1 wherein the unit tubes telescope through the collar of the stays to inside the cone area formed by the stays.

6. The device of claim 1 wherein the means for holding a plastic bag is a swivel hook with a pinching means attached to the bottom of the housing tube.

7. The device of claim 1 wherein the bottoms of the spring stays are rounded to limit snagging on rough surfaces.

8. The device of claim 1 wherein the means to hold the handle in an extended position comprises, in combination, a bent bar spring member of the gathering ring, attached to the lower end of the sliding tube; an opening part way up the wall of the housing tube in line with a depression at the top; a groove on the outside of the sliding tube in which the depression rides; wherein when the handle of the sliding tube is pulled upward the bent bar spring is guided to the opening in the housing tube into which it springs and can be pushed out for retraction.

* * * * *